US010601104B2

(12) United States Patent
Manivannan et al.

(10) Patent No.: US 10,601,104 B2
(45) Date of Patent: Mar. 24, 2020

(54) PRINTED RADIO FREQUENCY IDENTIFICATION ANTENNAS

(71) Applicant: Vorbeck Materials Corp., Jessup, MD (US)

(72) Inventors: Sriram Manivannan, Baltimore, MD (US); Mathew A Hudspeth, Cantonsville, MD (US); Jeremy D Smith, Annapolis, MD (US); Larry Hurzon, Alexandria, VA (US)

(73) Assignee: Vorbeck Materials Corp., Jessup, MD (US)

( * ) Notice: Subject to any disclaimer, the term of this patent is extended or adjusted under 35 U.S.C. 154(b) by 0 days.

(21) Appl. No.: 16/288,045

(22) Filed: Feb. 27, 2019

(65) Prior Publication Data

US 2019/0245261 A1 Aug. 8, 2019

Related U.S. Application Data

(63) Continuation of application No. 15/508,983, filed as application No. PCT/US2015/048724 on Sep. 4, 2015, now abandoned.

(60) Provisional application No. 62/046,161, filed on Sep. 4, 2014.

(51) Int. Cl.

| | |
|---|---|
| ***H01Q 1/22*** | (2006.01) |
| ***H01Q 7/00*** | (2006.01) |
| ***H01Q 9/28*** | (2006.01) |
| ***H01Q 1/36*** | (2006.01) |
| ***H01Q 1/38*** | (2006.01) |

(52) U.S. Cl.
CPC ..... *H01Q 1/2208* (2013.01); *H01Q 1/368* (2013.01); *H01Q 1/38* (2013.01); *H01Q 7/00* (2013.01); *H01Q 9/28* (2013.01)

(58) Field of Classification Search
CPC ..... H01Q 1/22; H01Q 1/2208; H01Q 7/00; H01Q 1/36; H01Q 1/368; H01Q 1/38; H01Q 9/28
See application file for complete search history.

(56) References Cited

U.S. PATENT DOCUMENTS 6,839,035 B1 * 1/2005 Addonisio ..... G06K 7/10178 340/572.1
6,885,354 B2 * 4/2005 Takei ..... G06K 19/07728 343/700 MS
7,088,304 B2 * 8/2006 Endo ..... G06K 19/0726 343/788

(Continued)

*Primary Examiner* — Tho G Phan
(74) *Attorney, Agent, or Firm* — Trentice V. Bolar, Esq.

(57) ABSTRACT

Embodiments of the present invention relate to a symmetrical RFID antenna and method of formation. In one embodiment, the radio frequency identification antenna comprises a loop element having sides. A first and second conductive elements are in electrical communication with and extend opposite from a middle portion of a side. A third and fourth conductive elements are in electrical communication with and oppositely extend from a second side. A fifth conductive element extends from a vertex of the second conductive element to a vertex of the forth conductive element. The second and/or forth conductive elements comprise a quadrilateral portion. The second and/or forth conductive elements comprise a width that is at least about the length of a side included in the plurality of sides.

19 Claims, 10 Drawing Sheets

(56) References Cited

U.S. PATENT DOCUMENTS

| | | | | |
|---|---|---|---|---|
| 9,024,837 | B2 * | 5/2015 | Dokai | H01Q 1/2208 343/742 |
| 9,450,303 | B2 * | 9/2016 | Su | H01Q 1/526 |
| 9,478,850 | B2 * | 10/2016 | Bourilkov | H01Q 1/38 |
| 2005/0024287 | A1 * | 2/2005 | Jo | G06K 19/0726 343/822 |
| 2015/0053770 | A1 * | 2/2015 | Preikszat | G06K 19/07783 235/492 |

* cited by examiner

PRINTED RADIO FREQUENCY IDENTIFICATION ANTENNAS

CROSS-REFERENCE TO RELATED APPLICATIONS

This application is a continuation of U.S. patent application Ser. No. 15/508,983 filed Mar. 6, 2017, which claims the benefit of PCT Application No. PCT/US15/48724 filed Sep. 4, 2015, which claims priority to U.S. Provisional Application No. 62/046,161 filed Sep. 4, 2014, which are both hereby incorporated herein by reference in their entirety.

BACKGROUND

The present invention relates generally to antennas and specifically to printed radio frequency identification antennas. Radio-frequency identification ("RFID") is the wireless use of electromagnetic ("EM") fields to transfer data for the purposes of identifying and/or tracking objects. RFID tags ("tags") can contain integrated circuits having memory for information storage. Some tags may be powered by and read at short ranges, such as a few meters, via electromagnetic fields that are typically generated by EM induction. Other tags can use a local power source such as a battery, or where a local power source is unavailable can collect energy from the interrogating EM field, and then act as a passive transponder to emit microwaves or UHF radio waves (i.e., EM radiation at high frequencies).

DETAILED DESCRIPTION

Figure 1:
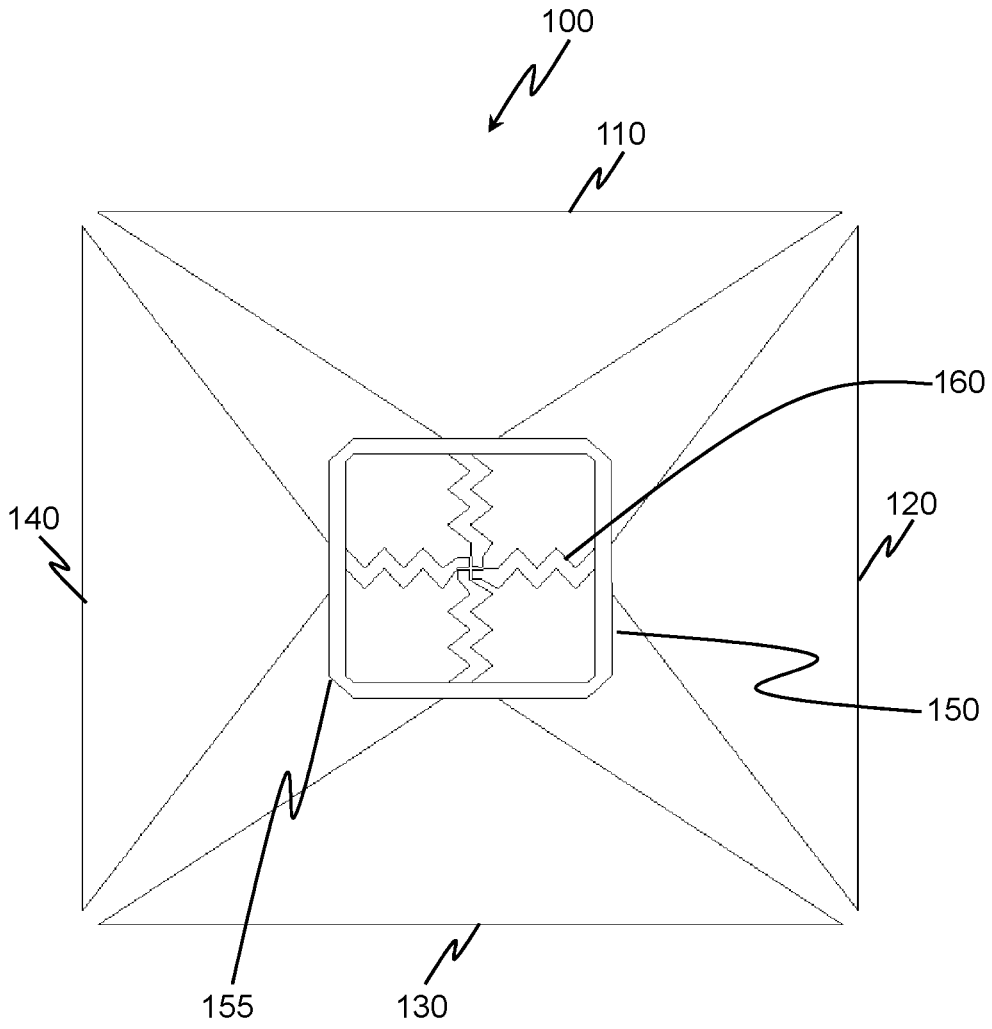
FIG. 1 depicts an antenna, generally 100, in accordance with an embodiment of the present invention.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvements over technologies found in the marketplace, or to enable others of ordinary skill in the art to understand the embodiments disclosed herein. Furthermore, references to proximal ends/portions refer to areas nearest to the integrated circuit ("IC") landing pads of conductor lines (discussed below) and references to distal ends/portions refer to areas furthest away from the IC landing pads. The conductive elements described below comprise a length that is parallel with the horizontal plane of the nearest conductor line and a width that is measured on a plane orthogonal to that of the length.

Radio-frequency identification ("RFID") is the wireless use of electromagnetic ("EM") fields to transfer data and may be utilized in an variety of applications, for example, identifying and tracking objects. RFID tags ("tags") can contain electronically stored information. Some tags can be powered by and read at short ranges, such as a few meters, via electromagnetic fields that are typically generated by EM induction. Other tags may use a local power source such as a battery, or where a local power source is unavailable may collect energy from the interrogating EM field, and then act as a passive transponder to emit microwaves or UHF radio waves (i.e., EM radiation at high frequencies).

Embodiments of the present invention seek to provide printable RFID antennas ("the antennas"). Additional aspects of the present invention seek to provide methods of fabricating the antennas. The antenna elements of the present invention can be printed utilizing a composition comprised of electrically conductive inks ("the composition"). The composition can include one or more conductive materials including, but not limited to, graphene sheets, graphite, conductive carbons, and/or conductive polymers (discussed further below). The antennas can be formed in a manner to operate within a variety of frequencies, including, but not limited to, HF, VHF, UHF, L, S, C, X, Ku, K, Ka, V, W, mm, A, B, C, D E, F, G H, I, J, K, L, and M.

Certain antenna elements can comprise a metal-based composition. Applicable metals include, but are not limited to, silver, gold, aluminum, and/or copper. The graphene sheets, the composition, and/or the printing methods can be derived and/or accomplished by a variety of manners, including but not limited to, those disclosed by, for example, U.S. Pat. No. 7,658,901 B2 by Prud'Homme et al., United States patent application 2011/0189452 A1 by Lettow et al., McAllister et al. (*Chem. Mater.* 2007, 19, 4396-4404), United States patent application 2014/0050903 A1 by Lettow et al., and U.S. Pat. No. 8,278,757 B2 by Crain et al, which are hereby incorporated by reference in their entirety.

The antennas are designed to be utilized with an active or passive RFID integrated circuit ("IC"). The IC can have any carrier wave frequency, maximum read distance, memory size, function, encoding scheme, and/or security protocol. The antennas can have an overall symmetrical structure. The antennas may can be formed to function as dipole antennas. The antennas may comprise an electrically conductive loop element that is in electrical communication with two or more conductive elements. Loop elements can comprise the composition and/or a metal-based composition. Conductive elements can comprise the composition. Conductive elements can be any multi-sided structure, for example, three-, four-, five-, six-, seven-, eight-, etc. sided structures. ICs can comprise a memory component to store data, and a processing unit to process the data and/or modulate and demodulate RF signals. The data may include, for example, a number or alphanumeric expression identifying the tag and/or identifying information for the object to which the tag is attached, such as, for example, a serial number, identification number, stock number, lot number, and/or batch number. The antennas can receive and, in certain embodiments, transmit, RF signals. The antennas also comprise two or more conductor lines that each extend substantially from the middle of opposite sides of the loop element. The conductor lines comprise a proximate end that includes an IC pad and a distal end that is in electrical communication with the loop element. Conductor lines can comprise the metal-based composition.

FIG. 1 depicts an antenna, generally 100, in accordance with an embodiment of the present invention. Antenna 100 can comprise loop 150, which is in electrical communication with conductive elements 110, 120, 130, and 140. Loop 150 is in electrical communication with conductor lines 160, which may each extend substantially from the middle area of the inner frame of a side of loop 150 toward the inner hollow of loop 150. Loop 150 can have a circumference that is smaller than or approximately equal to a predetermined wavelength. Loop 150 can be a four-sided (i.e. a quadrilateral) structure. Loop 150 can be a substantially square structure. Loop 150 can have one or more mitered corners 155. Each non-mitered side of loop 150 can be individually in electrical communication with conductive elements 110, 120, 130, or 140.

Mitered corners 155 can each have different or identical angles relative to a side of loop 150. Applicable angles can include, but are not limited to, at most 20° to 30°, 30° to 40°, 40° to 50°, 50° to 60°, 60° to 70°, or 70° to 80° relative to a side of loop 150. The width of the sides of loop 150 can be identical and/or different. Loop 150 can have one or more sides having a width that is at most 0.5 mm to 0.75 mm, 0.75 mm to 1 mm, 1 mm to 1.25 mm, 1.25 mm to 1.5 mm, 1.5 mm to 1.75 mm, or 1.75 mm to 2 mm.

Conductor lines 160 can have a serrated structure having a plurality of dentitions of one or more angles. Applicable dentition angles include, but are not limited to, acute angles, right angles, obtuse angles, and/or reflex angles. Conductor lines 160 can be of substantially equal lengths and/or widths. Conductor lines 160 can have widths that are greater than their associated IC pads. The proximal portions of conductor lines 160 can be tapered to the width of their IC associated pads.

Conductive elements 110, 120, 130, and 140 are conductive antenna elements. Conductive elements 110, 120, 130, and/or 140 can have a quadrilateral shape. The quadrilateral shape can have at least two substantially identical convex vertices. The quadrilateral shape can have a length that is at least 15% to 20%, 20% to 25%, 25% to 30%, 30% to 35%, 35% to 40%, 40% to 45%, 45% to 50%, 50% to 55%, or 55% to 60% its width. Conductive elements 110, 120, 130, and 140 can each have distal portions that are each in electrical communication with a different side of loop 150. Two or more of conductive elements 110, 120, 130, and 140 may have similar dimensions and/or similar shapes. The quadrilateral shape can be trapezoidal. One or more distal vertices of conductive elements 110, 120, 130, and/or 140 can be located no more than 0.5 mm to 1 mm, 1 mm to 5 mm, 5 mm to 10 mm, or 10 mm to 15 mm from the nearest distal vertex of another conductive element that is in electrical communication with loop 150.

Figure 2:
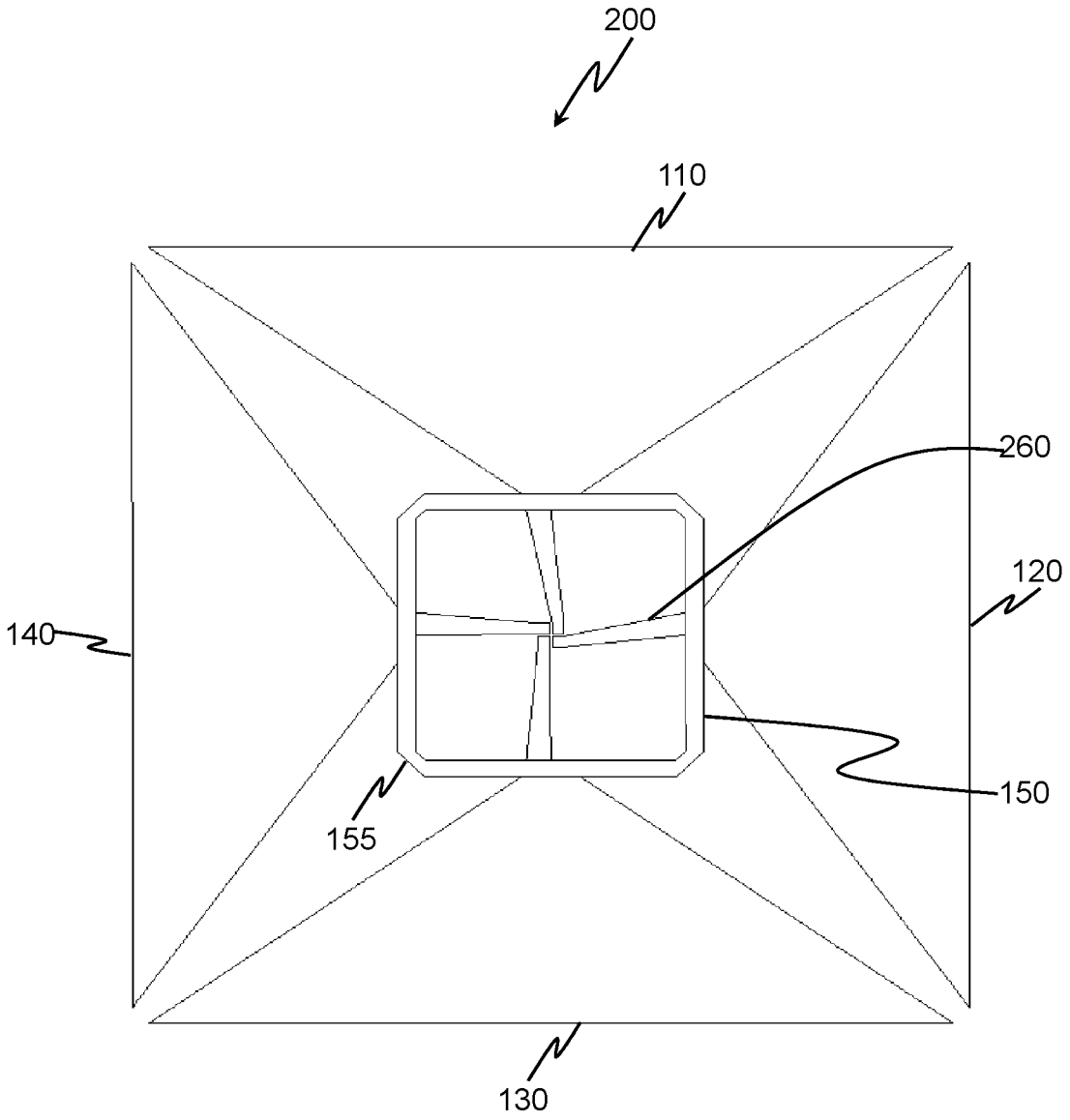
FIG. 2 depicts an antenna, generally 200, in accordance with an embodiment of the present invention.

FIG. 2 depicts an antenna, generally 200, in accordance with an embodiment of the present invention. Antenna 200 comprises some antenna elements that are also included in antenna 100, which can have similar dimensions and/or orientations as discussed above. Specifically, antenna 200 can comprise loop 150, mitered corners 155, and conductive elements 110, 120, 130, and/or 140.

Antenna 200 also comprises conductor lines 260, which can be in electrical communication with loop 150 in a similar manner as conductor line 160 are relative to loop 150. Conductor lines 260 have distal ends that are wider than their associated proximal end. Conductor lines 260 distal ends can have a width that is about 1.5× to 1.75×, 1.75× to 2×, 2× to 2.25×, 2.25× to 2.5×, 2.5× to 2.75×, or 2.75× to 3× the width of their associated proximal ends.

Figure 3:
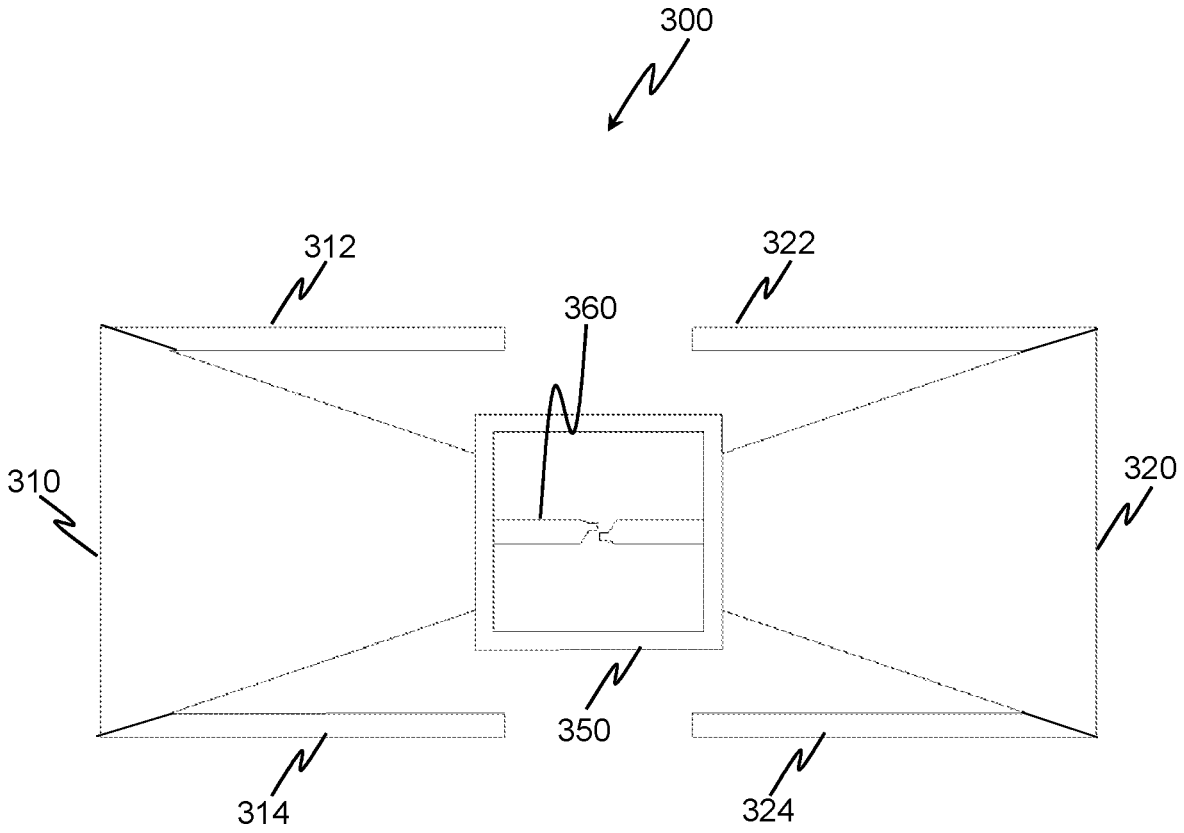
FIG. 3 depicts an antenna, generally 300, in accordance with an embodiment of the present invention.

FIG. 3 depicts an antenna, generally 300, in accordance with an embodiment of the present invention. Tag 300 can comprise loop 350, which is in electrical communication with conductive elements 310 and 320. Loop 350 is a four-sided structure that is in electrical communication with the distal ends of conductor lines 360. Loop 350 can have one or more sides that comprise similar widths as one or more of the sides of loop 150. Conductor lines 360 each have proximal ends that includes an IC pad. Conductor lines 360 can each have distal ends that extend substantially at a 90° angle from the middle area of a side of loop 350. Conductor lines 360 can each have overall widths that are similar to or wider than their IC pads. Conductor lines 360 can have proximal ends that are tapered to about the width of their IC pads. Conductor lines 360 can have equal lengths and/or widths compared to each other.

Conductive elements 310 and 320 are conductive antenna elements. Conductive elements 310 and 320 can each have a quadrilateral shape. Conductive elements 310 and/or 320 can be trapezoidal. Conductive elements 310 and 320 can have similar dimensions compared to each other. Conductive elements 310 and/or 320 can have at least two similarly angled vertices. Conductive elements 310 and/or 320 can have a proximal width that is at least 50% to 55%, 55% to 60%, 60% to 65%, 65% to 70%, 70% to 75%, 75% to 80%, 80% to 85%, or 85% to 90% the length of their associated distal widths. Conductive elements 310 and/or 320 can each have a length that is 35% to 40%, 40% to 45%, 45% to 50%, 50% to 55%, 55% to 60%, 60% to 65%, 65% to 70%, or 70% to 75% of their related widths.

Antenna 300 can also comprise elements 312 and/or 314 that each extend from an opposite distal vertex of conductive elements 310 towards the median vertical axis of loop 350. Elements 312 and/or 314 can each be oriented relative to a non-parallel side of conductive 310 at an angle of 1° to 5°, 5° to 10°, 10° to 15°, 15° to 20°, 20° to 25°, 25° to 30°, 30° to 35°, 35° to 40°, 40° to 45°, 45° to 50°, 50° to 55°, 55° to 60°, 60° to 75°, 65° to 70°, or 70° to 75°. Elements 312 and/or 314 can have a length that is about 1% to about 5%, 5% to about 10%, 10% to about 15%, or about 15% to about 20 less than or greater than the length of conductive element 310. Elements 312 and/or 314 can have a width that is less than, greater than, or equal to the width of a side of loop 350 or conductor lines 360. Elements 322 and 324 can have similar dimensions and/or orientations relative to conductive element 320 compared to elements 312 and 314 relative to conductive element 310.

Figure 4:
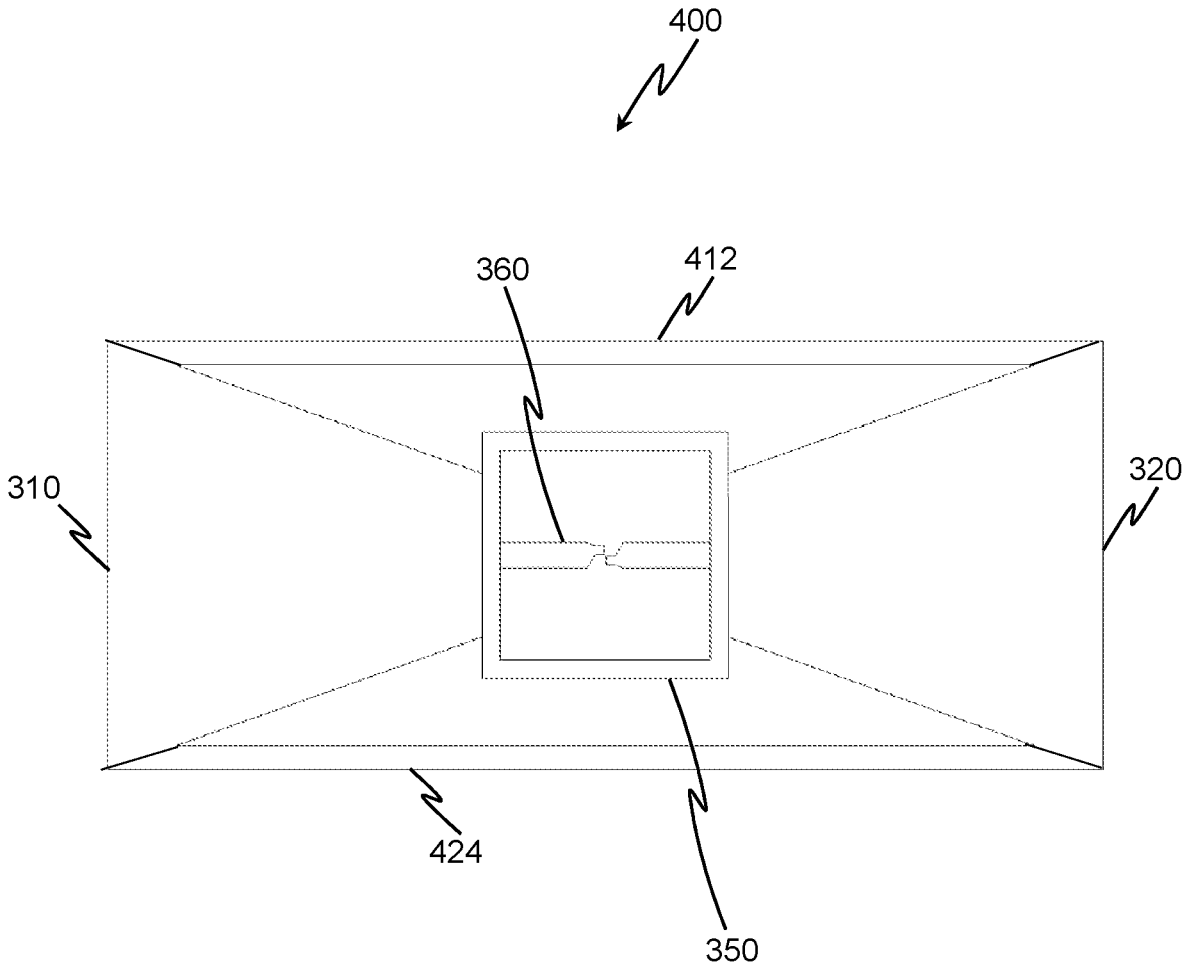
FIG. 4 depicts an antenna, generally 400, in accordance with an embodiment of the present invention.
Figure 5:
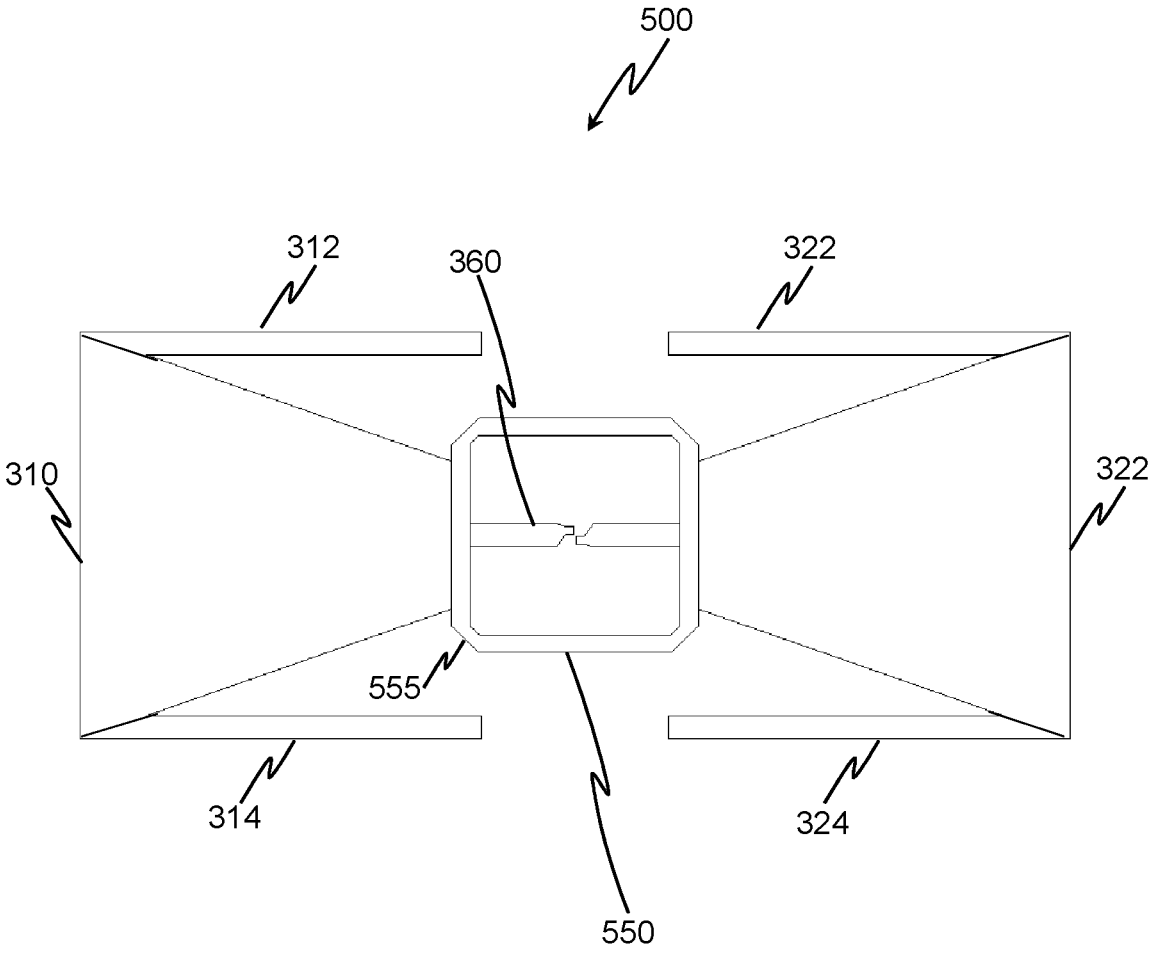
FIG. 5 depicts an antenna, generally 500, in accordance with an embodiment of the present invention.

FIG. 4 depicts an antenna, generally 400, in accordance with an embodiment of the present invention. Antenna 400 comprises some elements that are also included in antenna 300, which can have similar dimensions and/or orientations as discussed above. Namely, antenna 400 comprises loop 350, conductor lines 360, and conductive elements 310 and 320. Antenna 400 also comprises elements 412 and 424, which are each in electrical communication with conductive elements 310 and 320. Elements 412 and/or 424 can have a width that is similar, narrower, and/or wider than the width of a side of loop 350 or conductor lines 360. Elements 412 and 424 may each extend from an opposite distal vertex of conductive element 310 to the associated distal vertices of conductive element 320. FIG. 5 depicts an antenna, generally 500, in accordance with an embodiment of the present invention. Antenna 500 comprises some of the same elements that are included in antenna 300, which can have similar dimensions and/or orientations as discussed above. Namely, antenna 500 can comprise conductive elements 310 and 320, conductor lines 360, as well as elements 312, 322, 314, and 324.

Antenna 500 also comprises loop 550. Loop 550 is in electrical communication with conductor lines 360 and conductive elements 310 and 320. Loop 550 can comprise one or more mitered corners 555, which may have dimensions and/or orientations relative to loop 555 as mitered corners 155 can have relative to loop 155. Loop 550 may have similar dimensions and/or orientations as loop 150. Conductive elements 310 and/or 322 can each be in electrical communication with loop 550 in a similar manner as conductive elements 310 and/or 322 are relative to loop 350. Conductor lines 360 can be in electrical communication with loop 550 in a similar manner as conductive lines 360 are relative to loop 350.

Figure 6:
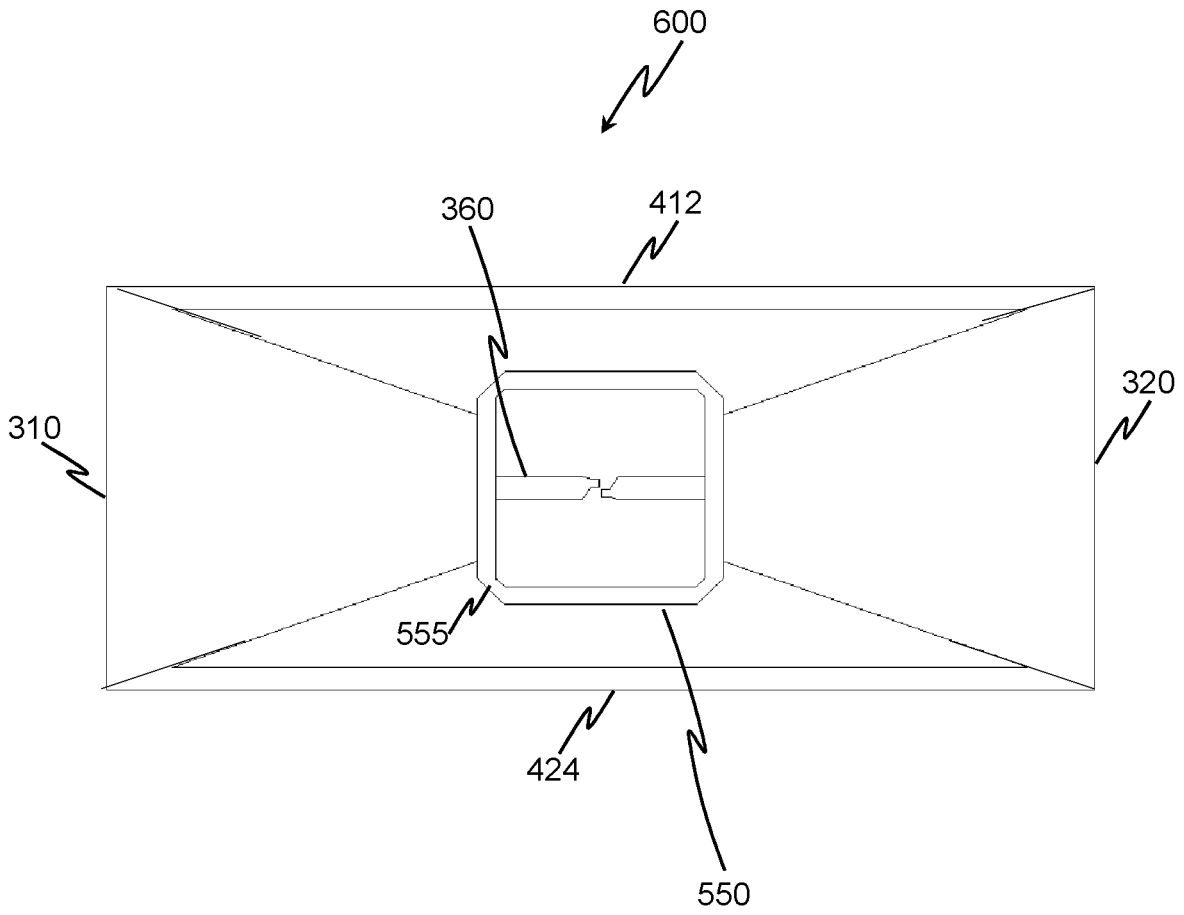
FIG. 6 depicts an antenna, generally 600, in accordance with an embodiment of the present invention.

FIG. 6 depicts an antenna, generally 600, in accordance with an embodiment of the present invention. Antenna 600 comprises some elements that are also included in antennas 300, 400, and 500, which can have similar dimensions and/or orientations as discussed above. Specifically, antenna 600 can comprise loop 550, conductor lines 360, conductive elements 310 and 320, and elements 412 and 424. Loop 550 is in electrical communication with conductor lines 360 and conductive elements 310 and 320. Conductive element 310 and 320 can have similar orientations and/or dimensions relative to elements 412 and 424 as discussed above.

Figure 7:
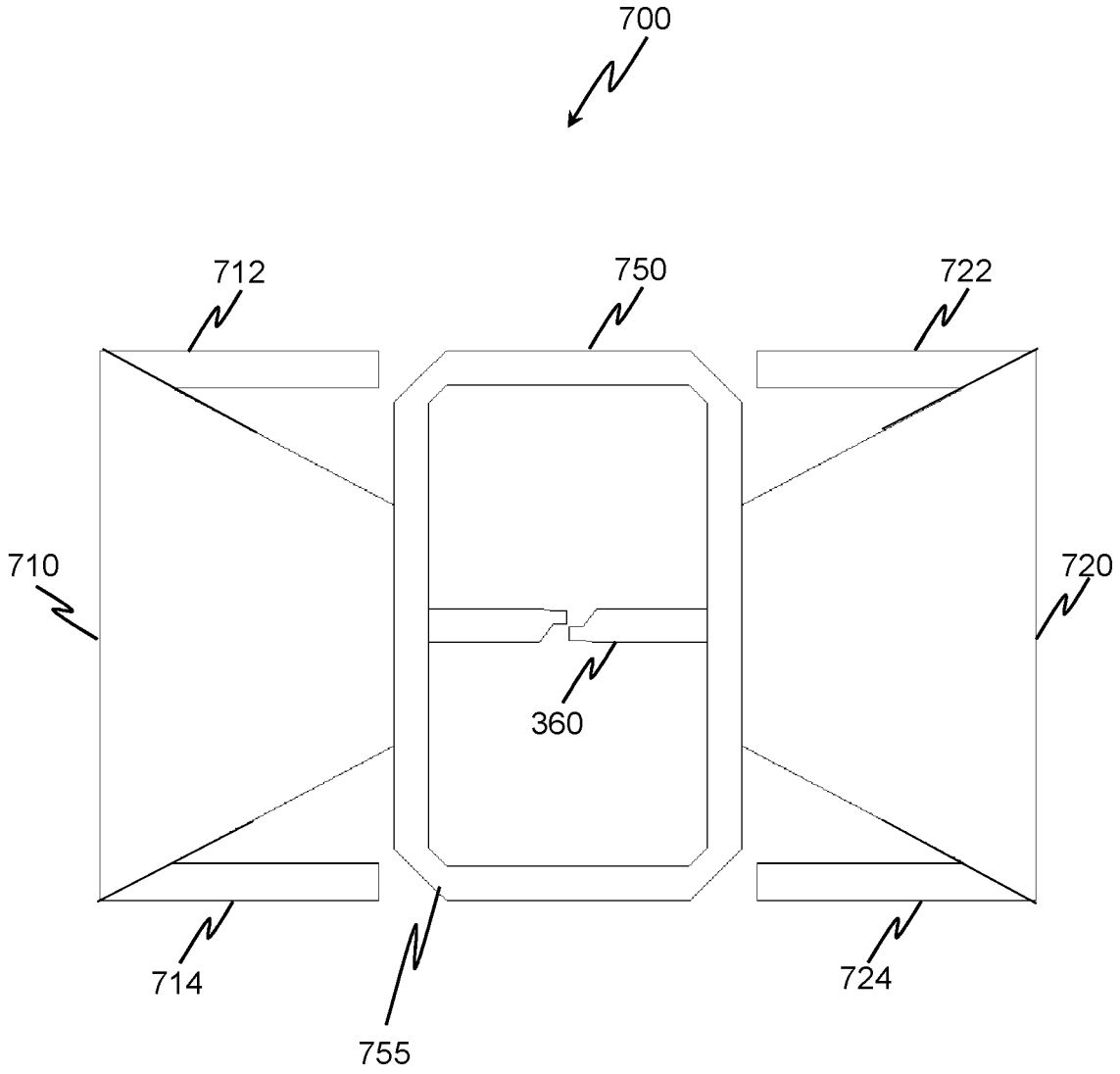
FIG. 7 depicts an antenna, generally 700, in accordance with an embodiment of the present invention.

FIG. 7 depicts an antenna, generally 700, in accordance with an embodiment of the present invention. Antenna 700 includes loop 750, which is in electrical communication with conductor lines 360. Loop 750 can have a length that is 30% to 35%, 35% to 40%, 40% to 45%, 45% to 50%, 50% to 55%, 55% to 60%, 60% to 65%, 65% to 70% its height. Loop 750 can comprise one or more sides that have a width that is about the width of conductive elements 710 and/or 720. Loop 750 can have a height that is substantially equal to the height of loop 150. Loop 750 can include mitered corners 755, which can have one or more similar orientations relative to a side of loop 750 as mitered corners 155 has relative to loop 150.

Antenna 700 can also include elements 712 and 714. Elements 712 and/or 714 can have a length that is shorter than the length of conductive elements 710. For example, elements 712 and/or 714 can have a length that is 70% to 75%, 75% to 80%, 80% to 85%, 85% to 90%, 90% to 95%, or 95% to 99% the width of conductive element 710. Elements 722 and/or 724 can have similar dimensions and/or orientations relative to conductive element 720 as elements 712 and/or 714 have relative to conductive element 710.

Figure 8:
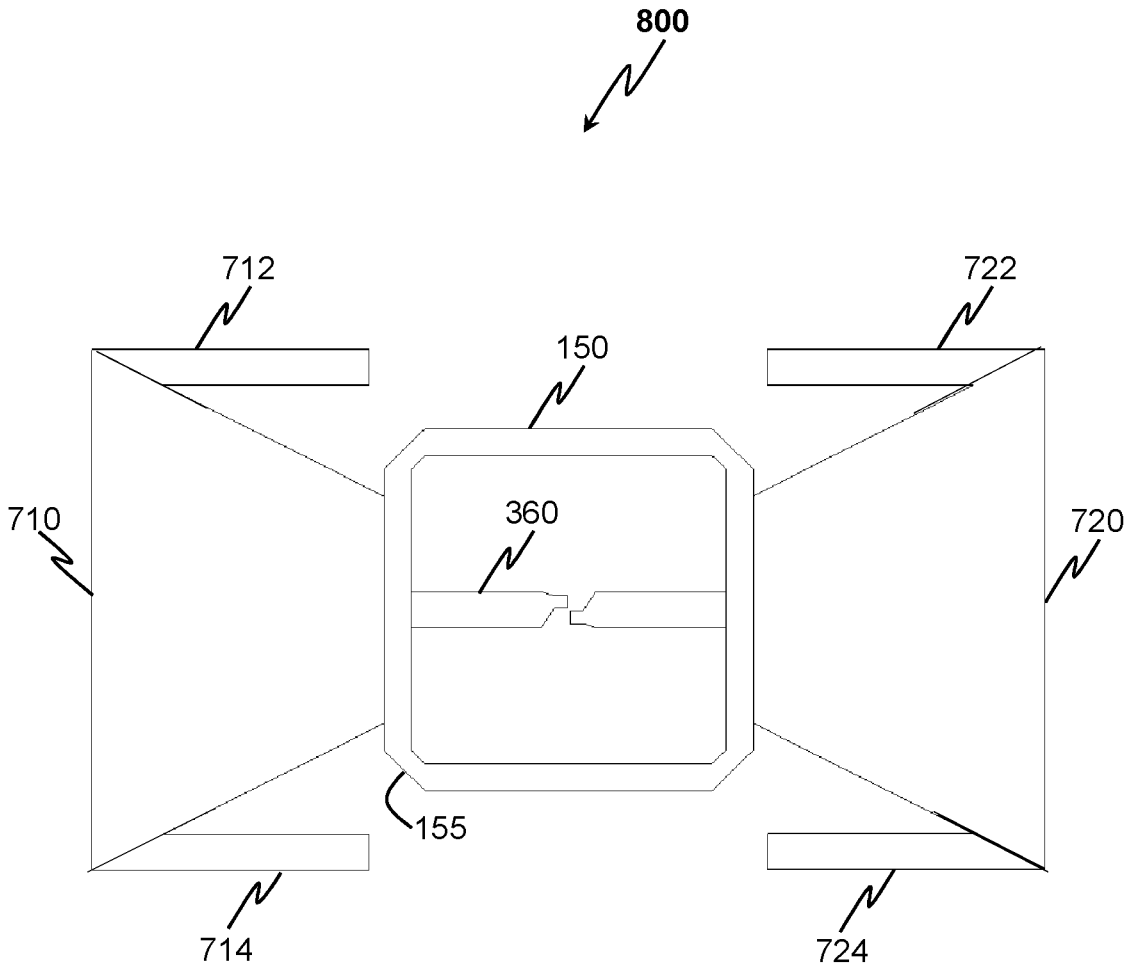
FIG. 8 depicts an antenna, generally 800, in accordance with an embodiment of the present invention.

FIG. 8 depicts an antenna, generally 800, in accordance with an embodiment of the present invention. Antenna 800 comprises elements that are also included in antennas 100, 300, and 700, which can have similar dimensions and/or orientations as discussed above. Specifically, antenna 800 comprises conductor lines 360, conductive elements 710 and 720, elements 712, 714, 722, and 724, loop 150, and mitered corners 155. Loop 150 is in electrical communication with conductor lines 360 and conductive elements 710 and 720. Conductive element 710 can be in electrical communication with elements 712 and 714. Conductive element 720 can be in electrical communication with elements 722 and 724.

Figure 9:
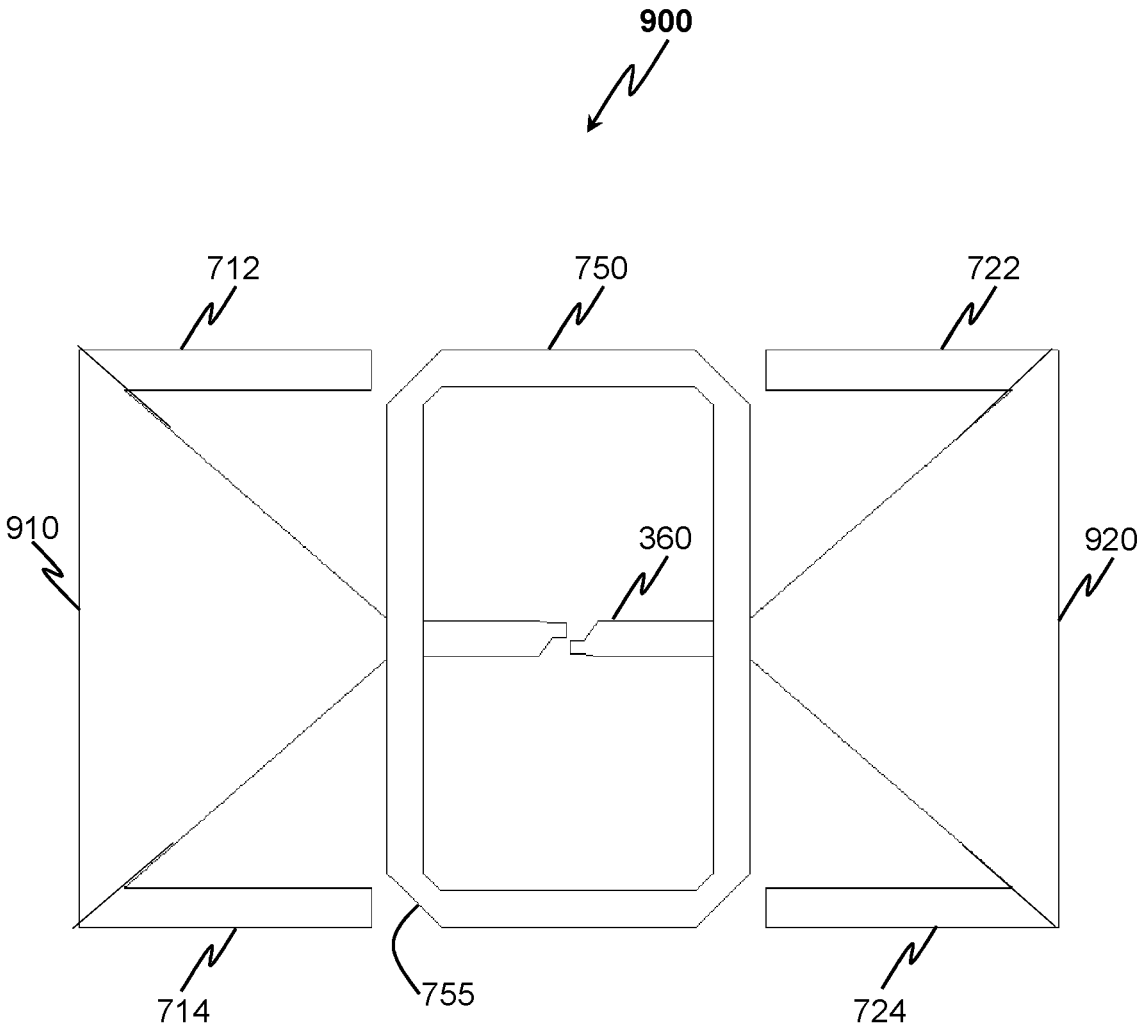
FIG. 9 depicts an antenna, generally 900, in accordance with an embodiment of the present invention.

FIG. 9 depicts an antenna, generally 900, in accordance with an embodiment of the present invention. Antenna 900 includes elements that are also included in antennas 300 and 700, which can have similar dimensions and/or orientations as discussed above. Specifically, antenna 900 can comprise loop 750, which is in electrical communication with conductor lines 360, and elements 712, 714, 722, 724. Antenna 900 can further comprise conductive elements 910 and 920, wherein the distal vertices of conductive element 910 are each in electrical communication with one of elements 712 and 714, and wherein the distal vertices of conductive element 920 are each in electrical communication with elements 722 and 724.

Conductive elements 910 and 920 may each have proximal ends that are in electrical communication with loop 750, wherein the connection points are each aligned substantially in the middle area of opposite sides of loop 750 each opposite to a conductor line 360. The proximal end of conductive elements 910 and 920 may be narrower that their associated distal ends, for example the proximal ends can have a width that is 1% to 5%, 5% to 10%, 10% to 15%, or 15% to 20% of the width of their associated distal ends. The distal portion of conductive elements 910 may be in electrical communication width elements 712 and 714, which can have similar associated dimensions as disclosed above and have an orientation relative to conductive element 910 that can be similar to the orientation and/or dimensions of elements 712 and 714 are relative to conductive element 710. Conductive elements 920 comprise elements 722 and 724, which can have similar associated dimensions as disclosed above and have an orientation relative to conductive element 920 that can be similar to the orientation of elements 722 and 724 are relative to conductive element 720.

Figure 10:
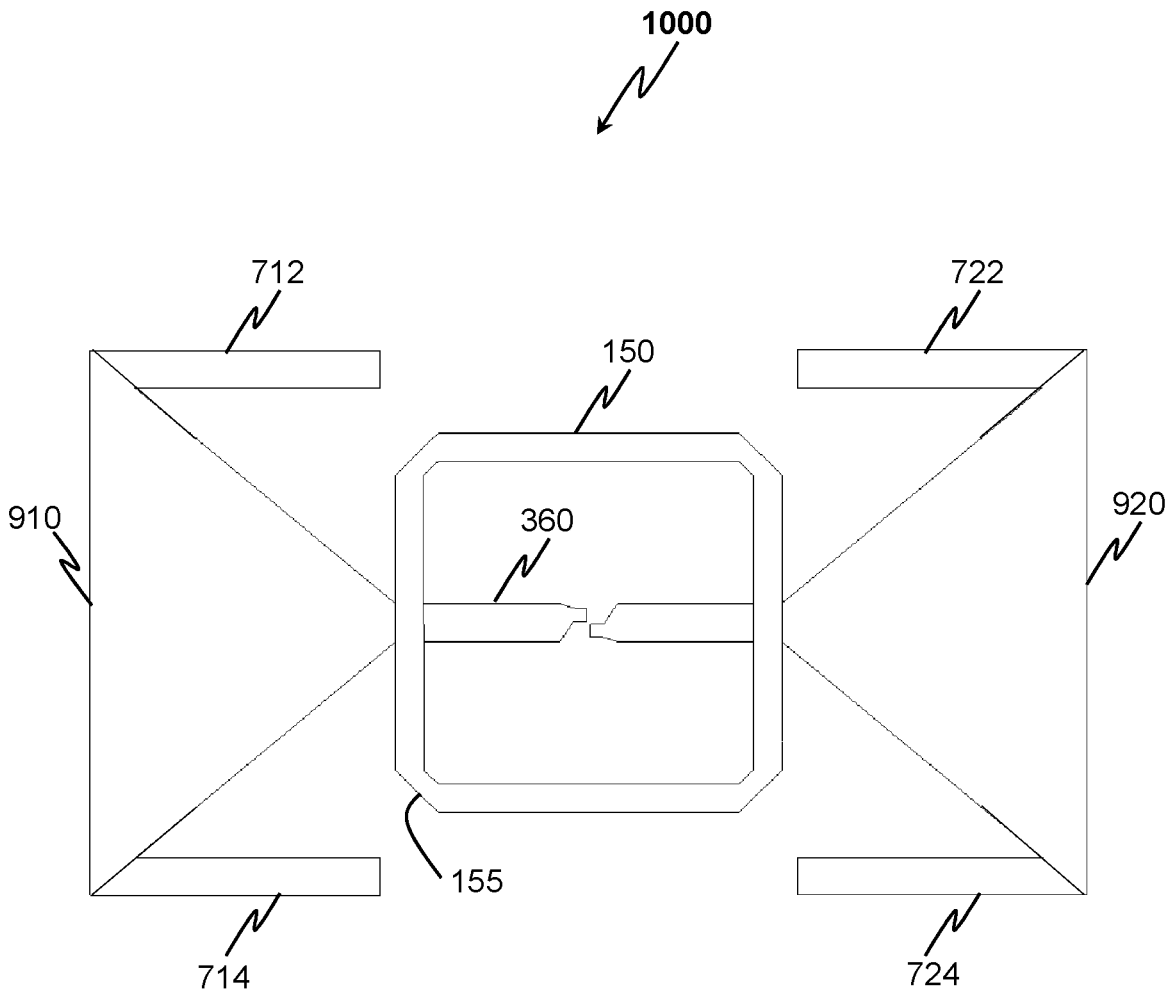
FIG. 10 depicts an antenna, generally 1000, in accordance with an embodiment of the present invention.

FIG. 10 depicts an antenna, generally 1000, in accordance with an embodiment of the present invention. Antenna 1000 comprises some elements that are also included in antennas 100, 300, 700, 800, and 900, which can have similar orientations and/or dimensions as disclosed above. Specifically, antenna 1000 comprise loop 150, which is in electrical communication with conductor lines 360 and conductive elements 910 and 920. Conductive elements 910 and 920 can each have an orientation relative to loop 150 that is similar to the orientation of conductive elements 910 and 920 have relative to loop 750 (discussed above). Distal vertices of conductive element 910 is in electrical communication with elements 712 and 714 as discussed above. The distal vertices of conductive element 920 are each in electrical communication with elements 722 and 724 as discussed above.

What is claimed is:

1. A radio frequency identification (RFID) antenna comprising:

a loop element comprising a plurality of sides, the plurality of sides comprising a first side positioned opposite a second side;

a first conductive element and a second conductive element in electrical communication with and extending in opposite directions substantially from a middle portion of the first side, and the first conductive element comprising an integrated circuit pad positioned distal to the first side;

a third conductive element and a fourth conductive element in electrical communication with and extending in opposite directions substantially from a middle portion of the second side, and the third conductive element comprising an integrated circuit pad positioned distal to the second side;

a fifth conductive element extending from a first distal vertex of the second conductive element to a second distal vertex of the fourth conductive element;

wherein one or more of the second conductive element and the fourth conductive element comprises a quadrilateral portion;

one or more of the second conductive element and the fourth conductive element comprises a width that is at least about the length of a side included in the plurality of sides;

one or more of the loop, the first conductive element, the second conductive element, the third conductive element, the fourth conductive element, and the fifth conductive element comprise an electrically conductive composition; and the RFID antenna comprises an overall symmetrical structure.

2. The RFID antenna of claim 1, wherein the loop element comprises a mitered corner that is positioned at most at 20° to 30°, 30° to 40°, 40° to 50°, 50° to 60°, 60° to 70°, or 70° to 80° relative to a side included in the plurality of sides.

3. The RFID antenna of claim 1, wherein the electrically conductive composition comprises one or more of silver, gold, aluminum, and copper.

4. The RFID antenna of claim 1, wherein the electrically conductive composition comprises a polymer and graphene sheets.

5. The RFID antenna of claim 1, wherein one or more of the second conductive element and the fourth conductive element comprises a proximal width and a distal width, and the proximal width is at least 50%-55% of the distal width.

6. The RFID antenna of claim 1, wherein the RFID antenna operates in one or more of a A, B, C, D E, F, G H, HF, I, J, K, Ka, Ku, L, mm, M, UHF, V, VHF, W, and X frequency band.

7. The RFID antenna of claim 1, wherein one or more of the first side and the second side comprises a width of 0.5 mm to 0.75 mm, 0.75 mm to 1 mm, 1 mm to 1.25 mm, 1.25 mm to 1.5 mm, 1.5 mm to 1.75 mm, or 1.75 mm to 2 mm.

8. The RFID antenna of claim 1, wherein one or more of the first conductive element and the third conductive element comprise a serrated structure, the serrated structure comprising a dentition, the dentition comprising one or more of an acute angle, a right angle, an obtuse angle, and a reflex angle.

9. The RFID antenna of claim 1, wherein the quadrilateral portion comprises a first side in communication with the loop element and a second side positioned opposite the first side, and the first side comprises a length that is at least about 15% to 20%, 20% to 25%, 25% to 30%, 30% to 35%, 35% to 40%, 40% to 45%, 45% to 50%, 50% to 55%, or 55% to 60% a length of the second side.

10. A method of forming a radio frequency identification (RFID) antenna comprising:

forming an electrically conductive composition;

forming, using the conductive composition, a loop element comprising a plurality of sides on a surface, the plurality of sides comprising a first side positioned opposite a second side;

forming, using the conductive composition, a first conductive element and a second conductive element on the surface to be in electrical communication with and extending in opposite direction substantially from a middle portion of the first side;

forming, using the conductive composition, a third conductive element and a fourth conductive element on to the surface to be in electrical communication with and extending in opposite direction substantially from a middle portion of the second side, the third conductive element formed to comprise an integrated circuit pad positioned distal to the second side;

forming, using the conductive composition, a fifth conductive element on to the surface to extend from a first distal vertex of the second conductive element to a second distal vertex of the fourth conductive element;

wherein forming one or more of the second conductive element and the fourth conductive element comprises forming one or more of the second conductive element and the fourth conductive element to comprise a quadrilateral shape;

one or more of the second conductive element and the fourth conductive element is formed to comprise a width that is at least about the length of a side included in the plurality of sides; and the RFID antenna is formed to comprise an overall symmetrical structure.

11. The method of claim 10, wherein one or more of forming the first conductive element, the second conductive element, the third conductive element, the fourth conductive element, and the fifth conductive element comprises a printing method.

12. The method of claim 10, wherein forming the loop element comprises forming the loop element to comprise a mitered corner positioned at most at 20° to 30°, 30° to 40°, 40° to 50°, 50° to 60°, 60° to 70°, or 70° to 80° relative to a side included in the plurality of sides.

13. The method of claim 10, wherein forming the electrically conductive composition comprises the use of one or more of silver, gold, aluminum, and copper.

14. The method of claim 10, wherein forming the electrically conductive composition comprises the use of a polymer and graphene sheets.

15. The method of claim 10, wherein forming one or more of the second conductive element and the fourth conductive element comprise a proximal width and a distal width, and the proximal width is at least 50%-55% of the distal width.

16. The method of claim 10, wherein the RFID antenna is formed to operate in one or more of a A, B, C, D E, F, G H, HF, I, J, K, Ka, Ku, L, mm, M, UHF, V, VHF, W, and X frequency band.

17. The method of claim 10, wherein the one or more of the first side and the second side are formed to comprise a width of 0.5 mm to 0.75 mm, 0.75 mm to 1 mm, 1 mm to 1.25 mm, 1.25 mm to 1.5 mm, 1.5 mm to 1.75 mm, or 1.75 mm to 2 mm.

18. The method of claim 10, wherein forming one or more of the first conductive element and the third conductive element comprise forming a serrated structure on the surface, the serrated structure formed to comprise a dentition comprising one or more of an acute angle, a right angle, an obtuse angle, and a reflex angle.

19. The method of claim 10, wherein forming the quadrilateral shape comprises forming a first side to be in electrical communication with the loop element and a second side to be positioned opposite the first side; and the first side is formed to comprise a length that is at least 15% to 20%, 20% to 25%, 25% to 30%, 30% to 35%, 35% to 40%, 40% to 45%, 45% to 50%, 50% to 55%, or 55% to 60% a length of the second side.

* * * * *